US010023280B2

(12) United States Patent
Penven et al.

(10) Patent No.: US 10,023,280 B2
(45) Date of Patent: Jul. 17, 2018

(54) DEVICE FOR WINDING AND UNWINDING A CABLE AROUND A DRUM

(71) Applicant: THALES, Courbevoie (FR)

(72) Inventors: Paul Penven, Brest (FR); Jean-Jacques Lossec, Brest (FR); David Hervouet, Brest (FR)

(73) Assignee: THALES, Courbevoie (FR)

( * ) Notice: Subject to any disclaimer, the term of this patent is extended or adjusted under 35 U.S.C. 154(b) by 521 days.

(21) Appl. No.: 14/436,808

(22) PCT Filed: Sep. 23, 2013

(86) PCT No.: PCT/EP2013/069675
§ 371 (c)(1),
(2) Date: Apr. 17, 2015

(87) PCT Pub. No.: WO2014/060185
PCT Pub. Date: Apr. 24, 2014

(65) Prior Publication Data

US 2016/0167754 A1 Jun. 16, 2016

(30) Foreign Application Priority Data

Oct. 18, 2012 (FR) ..... 12 02786

(51) Int. Cl.
*B63G 7/06* (2006.01)
*B63G 9/06* (2006.01)
(Continued)

(52) U.S. Cl.
CPC ..... *B63G 7/06* (2013.01); *B63B 21/66* (2013.01); *B63G 9/06* (2013.01); *B66D 1/12* (2013.01); *B66D 1/485* (2013.01)

(58) Field of Classification Search
CPC .... B63G 7/00; B63G 7/04; B63G 7/06; B63B 21/66; B66D 1/00; B66D 1/02; B66D 1/12; B66D 1/40; B66D 1/485
See application file for complete search history.

(56) References Cited

U.S. PATENT DOCUMENTS 2,695,086 A 11/1954 Parker
6,798,632 B1 * 9/2004 Holmes ..... B63G 9/06 361/143

(Continued)

FOREIGN PATENT DOCUMENTS

DE 977801 C 7/1970
EP 0364126 A1 4/1990
EP 0475834 A1 3/1992

*Primary Examiner* — Benjamin P Lee
(74) *Attorney, Agent, or Firm* — Baker & Hostetler LLP

(57) ABSTRACT

A device for winding and unwinding a cable including a winch comprises a chassis, an electric motor for driving a drum in rotation in relation to the chassis, locking/unlocking means comprising a first induction coil and configured such as to immobilize the drum in relation to the chassis when the first coil is not being powered electrically, the device including a second induction coil that is powered electrically, dimensioned and arranged such that the magnetic field generated by the assembly formed by the first and second coils, when the first coil is powered electrically, is less than the magnetic field generated by the first coil at a point located at a distance from the winch that is greater than a predetermined threshold, the electrical energizing and de-energizing of the second coil being synchronized with the electrical energizing and respectively de-energizing of the first coil.

18 Claims, 3 Drawing Sheets

(51) Int. Cl.

| | |
|---|---|
| ***B66D 1/12*** | (2006.01) |
| ***B66D 1/48*** | (2006.01) |
| ***B63B 21/66*** | (2006.01) |

(56) References Cited

U.S. PATENT DOCUMENTS

| | | | | |
|---|---|---|---|---|
| 9,181,071 | B2 * | 11/2015 | Hagihara | B66D 3/20 |
| 9,389,281 | B2 * | 7/2016 | West | G01R 33/025 |
| 2007/0142231 | A1 * | 6/2007 | Theobald | B63G 7/06 505/100 |

* cited by examiner

DEVICE FOR WINDING AND UNWINDING A CABLE AROUND A DRUM

CROSS-REFERENCE TO RELATED APPLICATIONS

This application is a National Stage of International patent application PCT/EP2013/069675, filed on Sep. 23, 2013, which claims priority to foreign French patent application No. FR 1202786, filed on Oct. 18, 2012, the disclosures of which are incorporated by reference in their entirety.

FIELD OF THE INVENTION

The domain of the invention is naval mine warfare, and more specifically the implementation of a device able to wind, unwind and lock in a winding and unwinding state a cable about the drum of a winch. A winch may be carried on board a mine warfare ship such as a minehunter or a dredger to wind and unwind a cable connected to a mine warfare device such as a sonar or a device for simulating a magnetic and/or acoustic signature. Such a winch is used to place in the sea, tow and recover the mine warfare device.

BACKGROUND

In the context of mine warfare, it is desirable to minimize the magnetic signature of ships. Magnetic signature means the strength of the magnetic field generated by the ship at a point located at a predetermined distance from the ship. Keeping the magnetic signature of a ship beneath a certain threshold prevents mines from triggering when the ship passes, since mines conventionally trigger on detection of a magnetic field above a predetermined threshold.

For this purpose, weakly magnetic towing winches, such as winches with hydraulic motors and mechanical or hydraulic brakes, are conventionally used. However, such winches have the drawback of requiring a hydraulic power unit on board the ship, as well as staff trained to carry out hydraulic maintenance tasks (routine maintenance and part replacement). Furthermore, these devices are large, costly and difficult to control.

SUMMARY OF THE INVENTION

One purpose of the invention is to overcome the aforementioned drawbacks.

For this purpose, the applicant proposes an electric winch, i.e. a winch in which the means for driving the drum rotating in relation to the chassis of the winch include an electric motor. This type of winch overcomes the aforementioned drawbacks since it is compact, easy to control using control electronics, and easier to maintain than a hydraulic power unit. In particular, the applicant proposes a device for winding and unwinding a cable comprising electromagnetic locking/unlocking means for preventing and permitting rotation of the drum in relation to the chassis of the winch, which is static in relation to the ship.

However, using this type of device poses a new problem specific to the context of mine warfare. Indeed, an electromagnetic brake is, by its nature, the source of a strong magnetic field and has a significant magnetic signature that is incompatible with use of the winch in mine warfare. It conventionally includes an induction coil that generates a strong magnetic field when crossed by a current.

Another purpose of the invention is to propose a solution enabling the magnetic signature of the device for winding and unwinding a cable to be limited.

For this purpose, the invention relates to a device enabling a cable to be wound and unwound comprising a winch comprising a chassis, drive means and a drum, the drive means comprising an electric motor for driving a drum in rotation in relation to the chassis, locking/unlocking means of rotation of the drum in relation to the chassis to prevent and permit rotation of the drum in relation to the chassis, locking/unlocking means including a first induction coil referred to as the locking/unlocking coil. The locking/unlocking means are designed to immobilize the drum in relation to the chassis when the locking/unlocking coil is not powered electrically, the device also including a second induction coil, referred to as the feedback coil, said feedback coil being powered electrically, and dimensioned and designed such that the magnetic field generated by the assembly formed by the locking and feedback coils, when the locking/unlocking coil is powered electrically, is less than the magnetic field generated by the locking/unlocking coil at a point located at a distance at least equal to a predetermined threshold (greater than 0) of the winch, the electrical energizing and de-energizing of the feedback coil being synchronized with the electrical energizing and respectively de-energizing of the locking/unlocking coil.

This solution at least partially compensates for the magnetic field generated by the locking/unlocking coil away from the winch. In other words, the feedback coil enables the magnetic signature of the device to be limited away from the winch. Consequently, the device according to the invention generates a magnetic field weaker than the magnetic field of the winch. As such, it can be used in mine warfare on board a mine warfare ship.

This solution also makes it possible to ensure that, when the locking/unlocking coil is powered electrically, the magnetic field that it generates is at least partially compensated for, regardless of the value of the current crossing the locking/unlocking coil. It should be noted that the electrical field generated by the locking/unlocking coil is variable due to the fact that there are at least two usage phases of the winch in which the drum is immobilized or respectively in motion (to wind or unwind the cable).

Advantageously, the feedback coil and the locking/unlocking coil are powered by the same generator.

This advantageous solution makes it possible to at least partially compensate for the magnetic field generated by the electromagnetic brake when the locking/unlocking coil is powered electrically, and it does not require means for synchronizing generation of a magnetic field by the two coils. Synchronization occurs automatically on account of the two coils being powered by the same generator. Furthermore, this solution does not require a specific generator dedicated to reducing the magnetic signature, which makes the device less cumbersome.

Advantageously, the feedback coil is mounted in series with the locking/unlocking coil.

Advantageously, the product N1*S1 is substantially equal to the product N2*S2, in which N1 is the number of turns in the locking/unlocking coil, N2 is the number of turns in the feedback coil, S1 is the surface area of the turns of the locking/unlocking coil and S2 is the surface area of the turns of the feedback coil.

Advantageously, the feedback coil is powered electrically by a second generator and the device includes means for synchronizing the electrical energizing and de-energizing of the feedback coil with the electrical energizing and respectively de-energizing of the locking/unlocking coil.

Advantageously, the feedback coil is arranged such that the first current passing through the locking/unlocking coil and the second current passing through the feedback coil flow counterclockwise.

Advantageously, the locking/unlocking and feedback coils are coaxial.

Advantageously, the feedback coil is dimensioned and arranged such as not to disturb operation of the locking/unlocking means.

Advantageously, the feedback and braking coils are spaced along the axis of the locking/unlocking coil.

Advantageously, the section of the conducting wire forming the winding of the feedback coil, the length of same and the material from which same is made are chosen such that the resistance of the feedback coil is at least 10 times less than the resistance of the locking/unlocking coil.

Advantageously, the device includes means for at least partially compensating, at a point located away from the vicinity of the winch, for the magnetic field generated by the permanent residual magnetization of the winch resulting from the electrical powering of the locking/unlocking and feedback coils used to release the drum without exerting any braking torque on same.

Advantageously, the means for at least partially compensating for the magnetic field generated by the permanent residual magnetization of the winch include a permanent magnetization assembly including at least one permanent magnet.

Advantageously, the device includes at least one permanent magnet having a north-south axis parallel to the axis of the locking/unlocking coil.

Advantageously, the device includes a third coil mounted to be powered permanently by a supplementary generator able to generate a direct current, the third coil being dimensioned and arranged such as to compensate at least partially, at a point located away from the vicinity of the winch, for the magnetic field generated by the permanent residual magnetization of the winch caused by the electrical powering of the locking and feedback coils used to release the drum without exerting any braking torque on same.

The invention also relates to mine warfare equipment including a mine warfare ship carrying a device according to the invention, said device also including said towing cable and a mine warfare device such as a sonar or a device for simulating the magnetic and/or acoustic signature.

BRIEF DESCRIPTION OF THE DRAWINGS

Other features and advantages of the invention are set out in the detailed description below, given as a non-limiting example and with reference to the attached drawings, in which.

DETAILED DESCRIPTION

In the figures, the same elements are indicated using the same reference signs.

Figure 1:
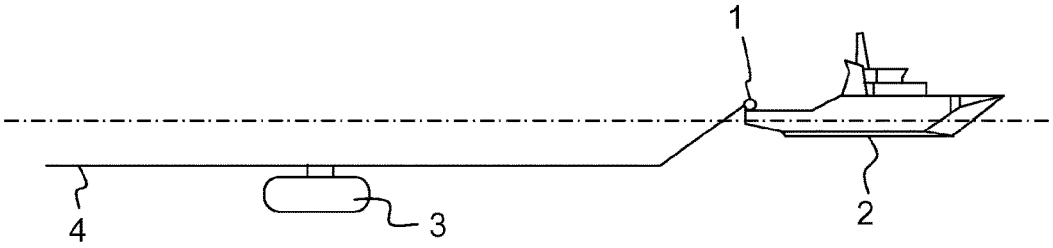
FIG. 1 is a schematic representation of a ship fitted with a device according to the invention.

FIG. 1 shows a ship 2 fitted with a device for winding and unwinding a cable according to the invention.

This device includes a winch 1 installed on a mine warfare ship 2 towing a mine warfare device 3 using a tow cable 4 arranged such that it can be wound about the winch 1. The water level is shown using a dot-dash line.

In the embodiment in the figure, the mine warfare device 3 is an active sonar in the form of a volumetric transceiver antenna. This device could be any other type of sonar or a device for simulating the magnetic and/or acoustic signature of a ship. These devices make it possible to simulate the magnetic field or the acoustic waves generated by a ship away from the ship such as to cause any mines to explode away from the ship.

Figure 2:
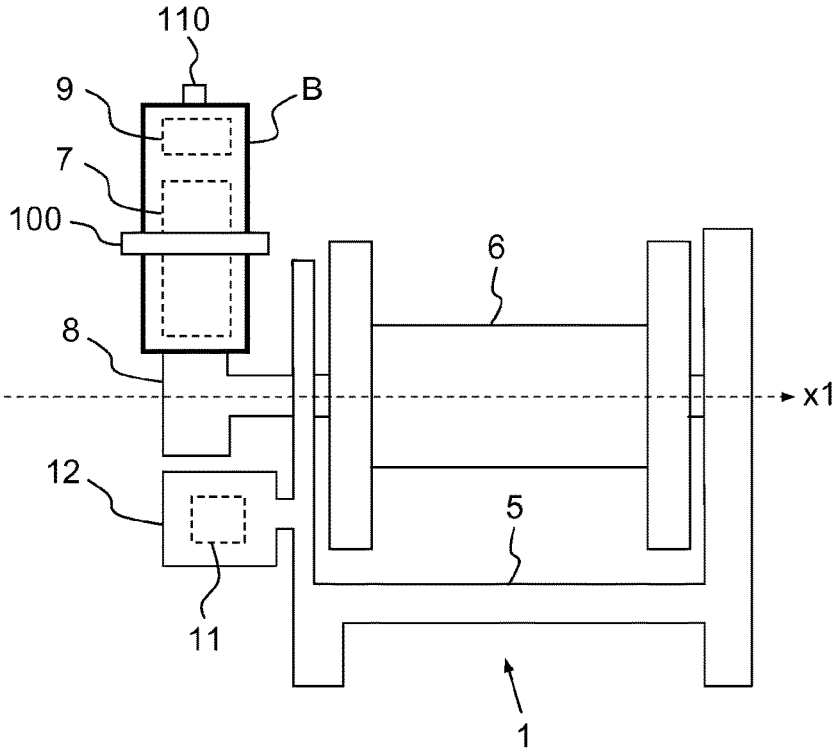
FIG. 2 is a schematic representation of the elements of the device according to the invention.

The winch 1 is dimensioned such that it can wind the tow cable 4 about a drum 6, shown in FIG. 2, unwind same and lock same in winding and unwinding states to enable the mine warfare device 3 to be recovered, placed in the sea and respectively held in operational position, as shown in FIG. 1, or in stowed position.

As shown in FIG. 2, the winch 1 includes a chassis 5 and the drum 6 which is movable in rotation in relation to the chassis 5 about a first axis x1. It also includes means for driving the drum 6 including an electric motor 7 enabling the drum 6 to be driven in rotation in relation to the chassis about the first axis x1.

Figure 3:
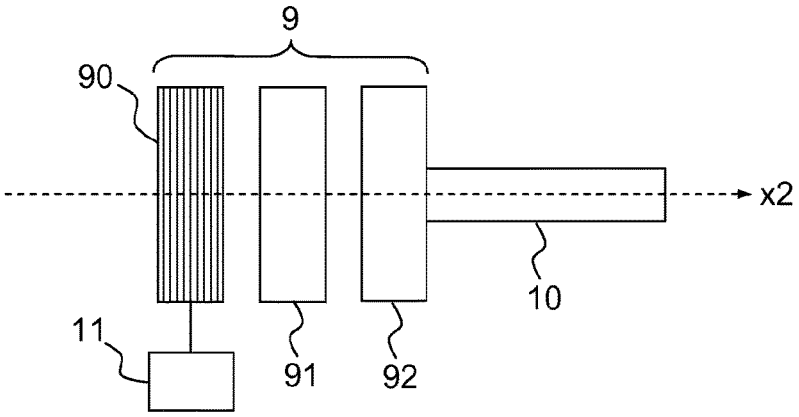
FIG. 3 is a schematic representation of the elements of an example of locking/unlocking means.

The drive means also include a device 8 for coupling the motor 7 to the drum 6 to transform a rotational movement of the rotor 10, shown in FIG. 3, of the motor 7 in relation to the chassis 5 about a second axis x2, that is for example but not necessarily perpendicular to the axis x1, into a rotational movement of the drum about the axis x1.

In other words, the rotation of the rotor 10 in relation to the chassis 5 about the axis x2 drives the drum 6 in rotation about the axis x1.

The coupling means 8 are, for example, a chain or a belt or a gear mechanism. The person skilled in the art is able to effect such coupling using a multitude of technical means.

The winch 1 also includes locking/unlocking means 9. These locking/unlocking means 9 include an electromagnet with a first induction coil 90 referred to as the locking/unlocking coil and shown in FIG. 3, arranged to be powered by power supply means including a generator 11.

The generator 11 may be built into the winch, as is the case in FIG. 2. In FIG. 2, it is rigidly connected to the chassis 5. It is more specifically built into a housing or cabinet 12 rigidly connected to the chassis 5. In a variant, the generator is located remotely on the ship, for example in a cabinet.

The generator 11 generates a direct current. The direct current may be constant or unidirectional variable current that can have several different values, or rectified alternating current.

The locking/unlocking means 9 are zero-current locking/unlocking means. This is then referred to as a parking brake. They are arranged to immobilize the drum in relation to the chassis when the coil 90 is not being electrically powered. In other words, they exert a braking torque on the drum 6 when the locking/unlocking coil is not electrically powered. The braking torque is used to immobilize the drum 6 in relation to the chassis 5 of the winch.

They are also designed to permit the drum 6 to rotate about the axis x1 when the first coil 90 is electrically powered by the generator without exerting any braking torque on the drum 6.

This is an ideal arrangement in the context of mine warfare since the locking/unlocking coil is powered and generates a magnetic field that increases the magnetic signature of the winch only when deploying and recovering the towed member, and not when the drum is immobilized to hold the towed member in operational position (tow line deployed with, for example, an immersed towed member 3*a*, 3*b*, as shown in FIG. 1) or in stowed position (tow cable wound about the drum). The drum 6 is more often immobilized than pivoting.

The locking/unlocking means 9 are advantageously arranged such that the braking torque exerted on the drum 6 is generated by a first braking torque exerted on the rotor 10.

This conventional type of locking/unlocking means is known to the person skilled in the art, who may implement different means to carry out same.

FIG. 3 shows an example of zero-current locking/unlocking means 9 arranged such that the braking torque exerted on the drum 6 is generated by a first braking torque exerted on the rotor 10, the value of which depends on the magnetic field created by the locking/unlocking coil 90.

In this example, the locking/unlocking means 9 include a locking/unlocking coil 90 rigidly connected to the chassis 5 of the winch. They also include a disk 91 made of a magnetic material, such as steel or another metal, constrained to rotate, in relation to the chassis 5, about the second axis x2, and movable along the second axis x2 under the effect of the magnetic field created by the coil 90. It is arranged such that it bears against the rotor 10 if there is no voltage at the terminals of the coil 90, thereby creating a first braking torque on the rotor 10 that prevents the rotor from rotating about the first axis x1. This torque is passed onto the drum 6 via coupling means 8, and the drum 6 is immobilized.

The disk 91 is arranged such that when there is voltage at the terminals of the locking/unlocking coil 90, under the effect of the first magnetic field generated by the locking/unlocking coil 90, it is attracted by the coil 90 such as to bear against same and to cease to exert any braking force on the rotor 10. The rotor can then turn unhindered, the drum 6 is freed to rotate and the coil exerts no braking force on the drum 6.

The person skilled in the art is able to carry out this type of locking/unlocking means in different ways.

The electromagnet may be formed by the first coil 90 or also include a core of soft ferromagnetic material. In the absence of current, the disk 91 can be held against the rotor 10 by a spring. In the presence of current, the first magnetic field opposes the force exerted by the spring such as to move the disk 91 against the coil 90 thereby permitting the rotor and the drum to rotate.

Significant force is required to move the disk 91, which means that the first coil has to be supplied with a strong current, which results in generation of a significant magnetic field by the coil of the brake 90.

The device also includes means for reducing the signature of the winch. These means also include a second coil 100, referred to as the feedback coil. In other words, the winch is fitted with a feedback coil. The feedback coil 100 is powered electrically, dimensioned and arranged such that the module, i.e. the intensity of the magnetic field generated by the assembly formed by the locking/unlocking and feedback coils 90, 100, when the locking/unlocking coil is powered electrically is less than the module of the magnetic field generated by the locking/unlocking coil 90 at a point located at a distance at least equal to a predetermined distance threshold. Furthermore, the electrical energizing and de-energizing of the feedback coil 100 are synchronized with the electrical energizing and respectively de-energizing of the locking/unlocking coil 90.

In other words, the feedback coil 100 is arranged to at least partially compensate for the magnetic field generated by the locking/unlocking coil away from the coils or from the winch when the locking/unlocking coil is energized electrically.

The distance threshold is a distance threshold guaranteeing that the point is away from the winch and advantageously from the ship to which it is attached. The distance threshold is for example 10 m.

Advantageously, the feedback coil 100 is assembled to be powered electrically by said generator 11. The two coils are therefore powered by the same generator.

In addition to the advantages set out above, if the generator is built into the winch 1, the device according to the invention does not require an external energy source to power the winch. It is independent of the ship. This makes assembly and disassembly of such a device on the mine warfare ship simple.

In another embodiment, not shown, the feedback coil is powered by a second generator separate from the first generator. The device includes means for synchronizing the electrical energizing and de-energizing of the feedback coil with the electrical energizing and respectively de-energizing of the locking/unlocking coil.

It should be noted that an induction coil has an axis that passes through the center of the coil and that extends substantially perpendicular to the plane in which a turn of the coil extends. A turn may have different shapes, for example an overall square or circular shape.

Figure 4:
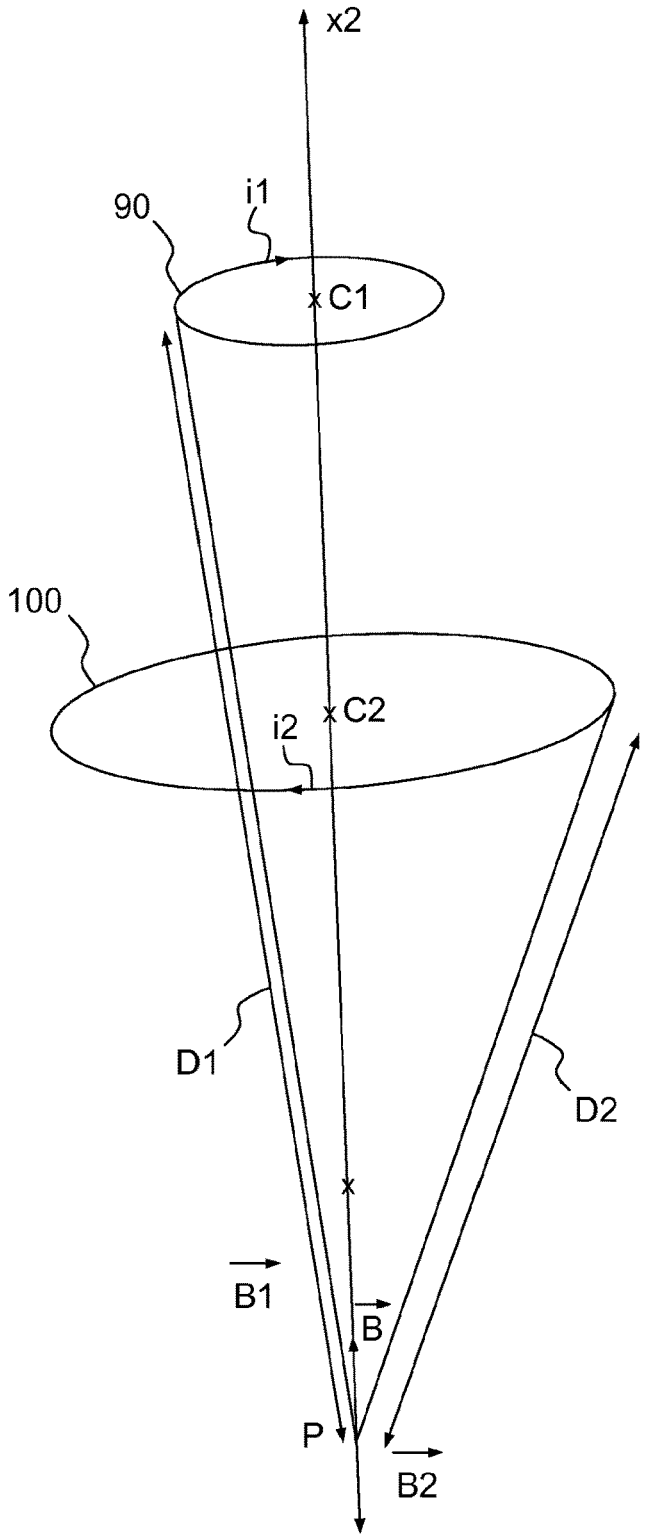
FIG. 4 is a schematic representation of the magnetic fields generated by the locking/unlocking and feedback coils on the axis of the coils when they are coaxial, as shown in FIG. 2.

Advantageously, as shown in FIG. 4, the feedback coil 100 is assembled such that the first current i1 flowing through the locking/unlocking coil 90 and the second current i2 flowing through the feedback coil 100 flow counterclockwise. This is carried out by an electrical assembly and a suitable arrangement of the winding of the feedback coil 100. The feedback coil can be arranged such as to have a second winding of a second electrical conductor provided in the opposite direction to the first winding of a first electrical conductor forming the locking/unlocking coil 90.

Advantageously, the feedback coil 100 is arranged such that the axis of same is parallel to the axis of the locking/unlocking coil 90.

Advantageously, as shown in FIG. 4, the feedback coil 100 is arranged such that it is coaxial with the locking/unlocking coil 90. Consequently, when the coils 90, 100 are powered electrically, the magnetic field vectors B1 and B2 generated by the two respective coils 90 and 100, at a point P of the axis of the coils, are opposed (for greater clarity, each coil is shown as one turn in FIG. 4). This positioning optimizes compensation since the fields generated by the coils are greatest on the axis of the coils.

In the embodiment shown in the figures, the axis x of the coils is the first axis x1.

In a variant, the axis of the feedback coil 100 is the same as the axis on which the intensity of the first magnetic field generated by the locking/unlocking means is greatest. Indeed, this axis can be offset in relation to the axis of the locking/unlocking coil 90.

Advantageously, the feedback coil 100 is dimensioned and arranged such that the module, i.e. the intensity, of the magnetic field B generated by the assembly formed by the first and second coils 90, when same are powered electrically by the generator 11, is less than the module, i.e. the intensity, of the magnetic field generated by the first coil 90 at a point located at a distance at least equal to the distance threshold and on the axis of the coils.

In the embodiment shown in the figures, the feedback coil 100 is positioned to surround the drive means. More specifically, it is positioned to surround the motor 7.

In the embodiment in FIG. 2, the drive means and the locking/unlocking means are arranged in a housing B or assembly rigidly connected to the chassis 5, shown in bold. The motor 7 and the locking/unlocking means 9 are shown using dotted lines since they are not normally visible as they are surrounded by the housing B.

The feedback coil 100 is rigidly connected to said housing. In other words, the coil 100 is rigidly connected to the chassis 5. The device according to the invention is therefore mechanically and electrically independent of the ship if the generator 11 is also rigidly connected to the chassis 5.

The dimensioning of the coil 100 depends on the material of the conducting wire forming the winding of the coil, the radius of the turns forming the winding or the section of same, and on the number of turns in the winding.

At a significant distance from the coils (i.e. at a distance greater than the distance threshold), the respective coils 90, 100 are considered to be assemblies comprising respective numbers N1 and N2 of turns with the same respective centers C1 and C2 corresponding to the respective centers of the coils 90, 100.

The first magnetic field B1 generated by the locking/unlocking coil 90 at a point P located on the axis of same is proportional to $i1*N1*S1/D1^3$ in which i1 is the current flowing through the locking/unlocking coil 90, N1 is the number of turns in the locking/unlocking coil 90, S1 is the surface area delimited by the coils of the winding forming the locking/unlocking coil and D1 is the distance separating the point from the locking/unlocking coil 90.

The second magnetic field B2 generated by the feedback coil at a point on the axis of same is proportional to $i2*N2*S2/D2^3$ in which i2 is the current flowing through the feedback coil, N2 is the number of turns in the feedback coil, S2 is the surface delimited by the turns of the winding forming the feedback coil and D2 is the distance separating point P from the feedback coil 100.

Away from the vicinity of the winch 1, the distances D1 and D2 are considered to be substantially equal.

Figure 5:
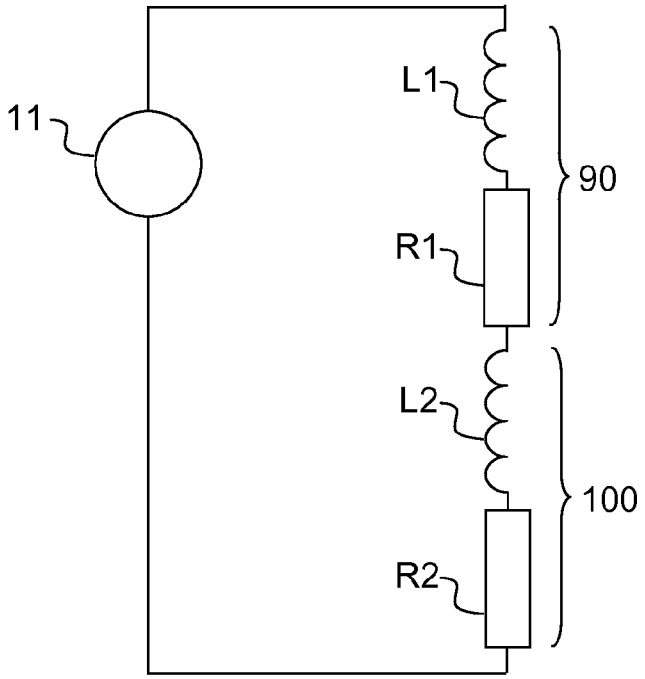
FIG. 5 is a schematic representation of an assembly in series of the locking/unlocking and feedback coils.

Advantageously, as shown in FIG. 5, the feedback coil 100 is mounted in series with the locking/unlocking coil 90. As such, the current flowing through the two coils 90, 100 is identical. This facilitates dimensioning of the device. The locking/unlocking and feedback coils are shown as inductors with a first value L1 and respectively a second value L2 associated with a first resistor R1 and respectively a second resistor R2.

Advantageously, the feedback coil 100 is dimensioned and arranged such that the intensity of the magnetic field generated by the device at a point located on the axis of the coils is less than a first predetermined intensity when the coils are powered by a predetermined current greater than zero ensuring the drum is free to rotate.

To compensate at least partially for the first magnetic field B1 at point P, it is sufficient to experiment with the second number of turns and on the second turn surface.

The locking/unlocking coil is advantageously dimensioned such that the product N1*S1 is substantially equal to the product N2*S2. Such dimensioning results in a good compromise between the actual compensation rate of the magnetic field and ease of dimensioning.

In practice, to dimension the coil, a feedback coil 100 with a predetermined surface area (or radius) is selected and installed on the winch 1. A position is selected at a predetermined point P located at a significant distance from the coils on the axis of the coils, then the number of turns in the winding forming the feedback coil is adjusted until the module of the magnetic field measured at the point in question is below a first predetermined threshold for a predetermined current flowing through the locking/unlocking coil. The products N1*S1 and N2*S2 are now not equal but substantially equal on account of the significant external disturbances caused by any other components making up the electromagnet (presence of magnetic material inside the coil (core effect)) and due to the fact that the center of the coils is distant on the axis x2 and the fact that the first threshold can be not zero. "Substantially" means that N1*S1 and N2*S2 are between 5% and 10%, to the nearest percentage point.

Figure 6:
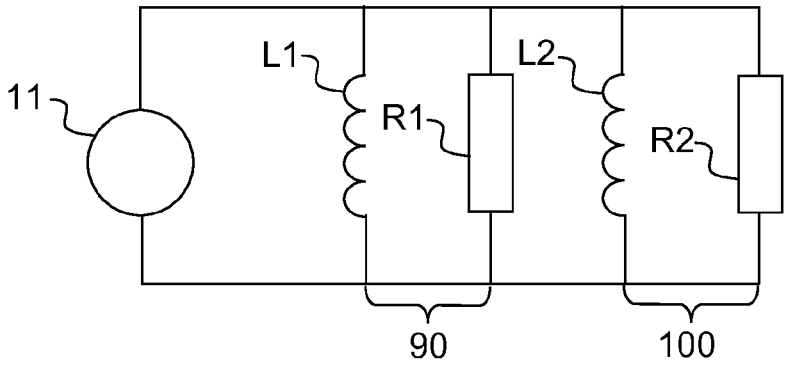
FIG. 6 is a schematic representation of an assembly in parallel of the locking/unlocking and feedback coils.

In a variant, as shown in FIG. 6, the feedback coil 100 is mounted in parallel with the locking/unlocking coil 90.

Advantageously, the feedback coil 100 is arranged and dimensioned such as not to disturb operation of the locking/unlocking means. In other words, the position of the feedback coil is selected such that when it is powered electrically with the predetermined current, the drum is not subject to any braking force.

To do so, the feedback coil 100 is advantageously positioned away from the locking/unlocking means 9, i.e. the extremities of the feedback and braking coils facing one another are spaced out on the axis of the locking/unlocking coil 90. Advantageously, the distance separating the coils is greater than a second predetermined threshold between 5 and 50 times the distance separating the locking/unlocking coil 90 and the magnetic element 91. The distance separating the two coils is the distance separating the adjacent (i.e. facing) extremities of the respective windings of same, parallel to the axes of the coils. This embodiment is shown in FIG. 2, the locking/unlocking coil 100 surrounds the motor 7 and not the locking/unlocking means 9.

Advantageously, the section of the conducting wire forming the winding of the feedback coil 100, the length of same and the material of same are chosen such that the resistance of the feedback coil is at least 10 times less than the resistance of the locking/unlocking coil. This obviates the need to significantly reduce the current that the generator causes to flow through the first coil.

The resistance of the locking/unlocking coil is given by the following formula $R1=\rho1*I1/s1$ in which s1 is the section of the cable from which it is made, ρ1 is the conductivity of the conducting wire from which it is made and I1 is the length of the conducting wire from which it is made. The resistance of the feedback coil is given by the following formula $R2=\rho2*I2/s2$ in which s2 is the section of the cable from which it is made, ρ2 is the conductivity of the conducting wire from which it is made and I2 is the length of the conducting wire from which it is made.

Advantageously, the section of the conducting wire forming the winding of the feedback coil is greater than the section of the conducting wire forming the winding of the locking/unlocking coil.

In order to limit the magnetic signature of the towing device according to the invention, the number of magnetic elements it comprises, in particular to form the winch 1, is advantageously limited.

It is not possible to make a winch 1 with no magnetic elements. Consequently, when the two coils 90, 100 generate magnetic fields, they contribute to magnetizing the magnetic elements of the winch. This magnetization tends to remain once the coils are no longer being powered electrically (hysteresis). In other words, the winch 1 will generate a third permanent magnetic field caused by the magnetization of the magnetic elements of the winch under the effect of the magnetic fields created by the coils. This third magnetic field is considered permanent since it exists permanently, once the coils have been powered for the first time by the generator.

The device according to the invention advantageously includes means 110 for compensating, at least partially and at a point located away from the vicinity of the winch, preferably on the axis of the locking/unlocking coil, for the magnetic field generated by the permanent residual magnetization of the winch 1 caused by the electrical powering of the locking/unlocking and feedback coils with a current flowing through the locking/unlocking coil intended to release the drum without exerting any braking torque on same.

In other words, these means are dimensioned and arranged such that the intensity of the magnetic field generated by the winch 1 away from the vicinity of the winch, preferably on the axis of the locking/unlocking coil, when the coils 90, 100 are not being powered electrically by the generator 11, is less than a second predetermined magnetic field threshold (for example around 5-10% of the intensity of the magnetic field created by the locking/unlocking coil on its own) after the generator 11 has powered the locking/unlocking coil with a current intended to permit the drum 6 to rotate without exerting any braking torque on same.

In the embodiment in FIG. 2, these compensation means include a permanent magnet 110 positioned such as to have a north-south axis parallel to the coil axis and having a plane of symmetry passing through the axis of the coils x1. This permanent magnet is for example rotationally symmetrical about the axis of the coils. This permanent magnet is rigidly connected to the chassis 5. In the embodiment in FIG. 5, it is adjacent, along the axis x, to the locking/unlocking means 9.

In a variant, these means include a permanent magnetization assembly comprising at least one permanent magnet, and potentially more, the number and respective positions of which are determined to at least partially compensate, at a point located away from the vicinity of the winch, for the magnetic field generated by the permanent residual magnetization of the winch 1 resulting from the electrical powering of the locking/unlocking and feedback coils, used to release the drum without exerting any braking torque on same. They preferably have north-south axes parallel to the axis of the locking/unlocking coil, and for example a plane of symmetry passing through the axis of the locking/unlocking coil.

In a variant, these means include a third coil mounted to be powered permanently by a supplementary generator able to generate a direct current, the third coil being dimensioned and arranged such as to compensate at least partially, at a point located away from the vicinity of the winch, for the magnetic field generated by the permanent residual magnetization of the winch 1 caused by the electrical powering of the locking/unlocking and feedback coils used to release the drum without exerting any braking torque on same.

Advantageously, the third coil is coaxial to the first and second coils.

Given that the residual permanent magnetization of the elements of the winch is not known in advance, this dimensioning and this positioning are carried out empirically, for example by measuring the residual magnetic field generated by the winch when the coils are not being powered electrically, after the generator 11 has powered the locking/unlocking coil with a current to enable the drum 6 to rotate without exerting any braking torque on same.

The device comprises only the winch and the compensation means as described above. It may also include the towing cable and the mine warfare device.

The invention also relates to mine warfare equipment including a mine warfare ship carrying a device according to the invention.

The invention claimed is:

1. A device for winding and unwinding a cable, comprising:

a winch comprising a chassis, drive means and a drum, wherein the drive means include an electric motor used to drive a drum in rotation in relation to the chassis, and means for locking/unlocking rotation of the drum in relation to the chassis to prevent and permit rotation of the drum in relation to the chassis, the locking/unlocking means including a first induction coil being a locking/unlocking coil, the locking/unlocking means being designed to immobilize the drum in relation to the chassis when the locking/unlocking coil is not powered electrically, the device also including a second induction coil, being a feedback coil, said feedback coil being powered electrically, and dimensioned and designed such that the magnetic field produced by an assembly formed by the locking/unlocking coil and the feedback coil, when the locking/unlocking coil is powered electrically, is less than the magnetic field generated by the locking/unlocking coil at a point located at a predetermined distance from the winch, the electrical energizing and de-energizing of the feedback coil being synchronized with the electrical energizing and respectively de-energizing of the locking/unlocking coil.

2. The device as claimed in claim 1, wherein the feedback coil and the locking/unlocking coil are powered by a same generator.

3. The device as claimed in claim 2, wherein the feedback coil is mounted in series with the locking/unlocking coil.

4. The device as claimed in claim 2, wherein the product N1*S1 is substantially equal to the product N2*S2, wherein N1 is the number of turns in the locking/unlocking coil, N2 is the number of turns in the feedback coil, S1 is the surface area of the turns of the locking/unlocking coil and S2 is the surface area of the turns of the feedback coil.

5. The device as claimed in claim 1, comprising a first generator for electrically powering the locking/unlocking coil and a second generator for electrically powering the feedback coil, the device including means for synchronizing the electrical energizing and de-energizing of the feedback coil with the electrical energizing and respectively de-energizing of the locking/unlocking coil.

6. The device as claimed in claim 1, wherein the feedback coil is arranged such that a first current flowing through the locking/unlocking coil and a second current flowing through the feedback coil flow counterclockwise.

7. The device as claimed in claim 6, wherein the locking/unlocking coil and feedback coil are coaxial.

8. The device as claimed in claim 1, wherein the feedback coil is dimensioned and arranged such as not to disturb operation of the locking/unlocking means.

9. The device as claimed in claim 8, wherein the feedback coil and the locking/unlocking coil are spaced along an axis of the locking/unlocking coil.

10. The device as claimed in claim 1, wherein a section of the conducting wire forming the winding of the feedback coil, the length of same and the material from which same is made are chosen such that the resistance of the feedback coil is at least 10 times less than the resistance of the locking/unlocking coil.

11. The device as claimed in claim 1, including means for at least partially compensating, at a point located away from the vicinity of the winch, the magnetic field generated by the permanent residual magnetization of the winch resulting from the electrical powering of the locking/unlocking coil and the feedback coil, used to release the drum without exerting any braking torque on same.

12. The device as claimed in claim 11, wherein the means for at least partially compensating, at a point located away from the vicinity of the winch, the magnetic field generated by the permanent residual magnetization of the winch resulting from the electrical powering of the locking/unlocking coil and the feedback coil, used to release the drum without exerting any braking torque include a set of at least one permanent magnet.

13. The device as claimed in claim 12, wherein at least one permanent magnet of the set of at least one permanent magnet has a north-south axis parallel to an axis of the locking/unlocking coil.

14. The device as claimed in claim 11, including a third coil assembled to be powered permanently by a supplementary generator able to generate a direct current, the third coil being dimensioned and arranged such as to compensate at least partially, at a point located away from the vicinity of the winch, for the magnetic field generated by the permanent residual magnetization of the winch caused by the electrical powering of the locking/unlocking coil and the feedback coil, used to release the drum without exerting any braking torque on same.

15. Mine warfare equipment including a mine warfare ship carrying a device as claimed in claim 1, said device also including said cable and a mine warfare device.

16. Mine warfare equipment as claimed in claim 15, wherein the mine warfare device comprises at least one of a sonar and a device for simulating a magnetic and/or acoustic signature.

17. The device as claimed in claim 1, the device being configured to be carried on board a mine warfare ship.

18. The device as claimed in claim 17, comprising the cable and a mine warfare device comprising at least one of a sonar and a device for simulating a magnetic and/or acoustic signature, the mine warfare device being intended to be towed by the mine warfare ship by means of the cable.

* * * * *